US012636567B2

(12) United States Patent
Eklund

(10) Patent No.: US 12,636,567 B2
(45) Date of Patent: May 26, 2026

(54) MECHANICAL PICKLEBALL SCOREKEEPER

(71) Applicant: Richard Eklund, Las Vegas, CA (US)

(72) Inventor: Richard Eklund, Las Vegas, CA (US)

( * ) Notice: Subject to any disclaimer, the term of this patent is extended or adjusted under 35 U.S.C. 154(b) by 356 days.

(21) Appl. No.: 18/517,358

(22) Filed: Nov. 22, 2023

(65) Prior Publication Data

US 2025/0032888 A1 Jan. 30, 2025

Related U.S. Application Data

(60) Provisional application No. 63/516,321, filed on Jul. 28, 2023.

(51) Int. Cl.
*A63B 71/06* (2006.01)
*A63B 102/08* (2015.01)

(52) U.S. Cl.
CPC ..... *A63B 71/0672* (2013.01); *A63B 2102/08* (2015.10)

(58) Field of Classification Search
CPC ..... A63B 71/0672; A63B 2102/08; A63B 71/0669; A63B 2071/0663
See application file for complete search history.

(56) References Cited

U.S. PATENT DOCUMENTS 544,907 A * 8/1895 Braine ..... A63B 71/0672 235/1 B
1,985,652 A * 12/1934 Campbell ..... A63B 71/0672 235/114
2,993,288 A 7/1961 Rothman
3,122,851 A * 3/1964 Sepe ..... A63B 71/0672 235/114
3,455,273 A 7/1969 Willingham, Jr.
4,165,710 A * 8/1979 Gaetano ..... A63B 71/0672 235/114
5,084,695 A 1/1992 Freeman
5,385,113 A * 1/1995 Hierath ..... A63B 71/0672 116/222
7,404,373 B2 * 7/2008 Bailey ..... A63B 71/0672 116/318
11,400,358 B1 * 8/2022 McKay ..... A63B 71/0672
12,134,023 B2 * 11/2024 Cunningham ..... A63B 71/0672
D1,082,567 S * 7/2025 Eklund ..... D10/46.1
2008/0026877 A1 1/2008 Neel
2012/0255482 A1 * 10/2012 Terenzoni ..... A63B 71/0672 116/223
2021/0113911 A1 * 4/2021 Madsen ..... A41D 20/00
2023/0330508 A1 * 10/2023 Spack ..... A63B 71/0672

* cited by examiner

*Primary Examiner* — Kristina M Deherrera
*Assistant Examiner* — Tania Courson
(74) *Attorney, Agent, or Firm* — Eric Karich; Karich & Associates

(57) ABSTRACT

A mechanical pickleball scorekeeper for enabling a user to track a score for each team in a pickleball match, and for tracking a server number during the match, has a housing sized and shaped to be hand-held by the user. Three dials are operably mounted on the housing. One of the three dials is a first team score dial that includes numbers circumferentially spaced around the top surface. A second dial is a second team score dial that includes numbers circumferentially spaced around the top surface. A third dial is a server number dial.

9 Claims, 4 Drawing Sheets

MECHANICAL PICKLEBALL SCOREKEEPER

BACKGROUND OF THE INVENTION

Field of the Invention

This invention relates generally to scorekeeping devices, and more particularly to a mechanical scorekeeping device specifically configured to track server and score of a pickleball game.

Description of Related Art

The prior art is well documented with examples of portable scorekeeping devices for assisting a person in keeping a correct score during game play. Some of these scorekeeping devices are electronic, and some are purely mechanical. Examples of an electronic device for gathering baseball data are shown, for example, in Freeman, U.S. Pat. No. 5,084,695 (umpire's counter), and Neel, U.S. 2008/0026877 (baseball data gathering device).

A mechanical pocket scoring device is shown in Willingham, U.S. Pat. No. 3,455,273, which includes wheels mounted in a housing, where manual rotation of the wheels enables a user to track the score of the game. A similar example is shown in Rothman, U.S. Pat. No. 2,993,288.

While it is known to track the score of a game using a mechanical counting device, it is not known to track both the score and the serve of a pickleball game using a unique device such as is taught by the present invention.

The prior art teaches various devices for tracking score of various sporting games. However, the prior art does not teach a mechanical pickleball scorekeeper that is easy to use to track both a serve and a game score. The present invention fulfills these needs and provides further advantages as described in the following summary.

SUMMARY OF THE INVENTION

The present invention teaches certain benefits in construction and use which give rise to the objectives described below.

The present invention provides a mechanical pickleball scorekeeper for enabling a user to track a score for each team in a pickleball match, and for tracking a server number during the match. The mechanical pickleball scorekeeper includes a housing sized and shaped to be hand-held by the user, the housing having a top surface that extends outwardly to an outer edge; three dials, each of the three dials having a top surface that extends outwardly to an outer perimeter edge, each of the three dials being operably mounted on the housing; wherein one of the three dials is a first team score dial that includes numbers circumferentially spaced around the top surface; wherein one of the three dials is a second team score dial that includes numbers circumferentially spaced around the top surface; and wherein one of the three dials is a server number dial.

A primary objective of the present invention is to provide a mechanical pickleball scorekeeper having advantages not taught by the prior art.

Another objective is to provide a mechanical pickleball scorekeeper that tracks both a server number and a score number for each team.

A further objective is to provide a mechanical pickleball scorekeeper that is handheld and easy to use for tracking all of the necessary information needed during a pickleball game.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention.

DETAILED DESCRIPTION OF THE INVENTION

The above-described drawing figures illustrate the invention, a mechanical pickleball scorekeeper for tracking information about a pickleball game.

Figure 1:
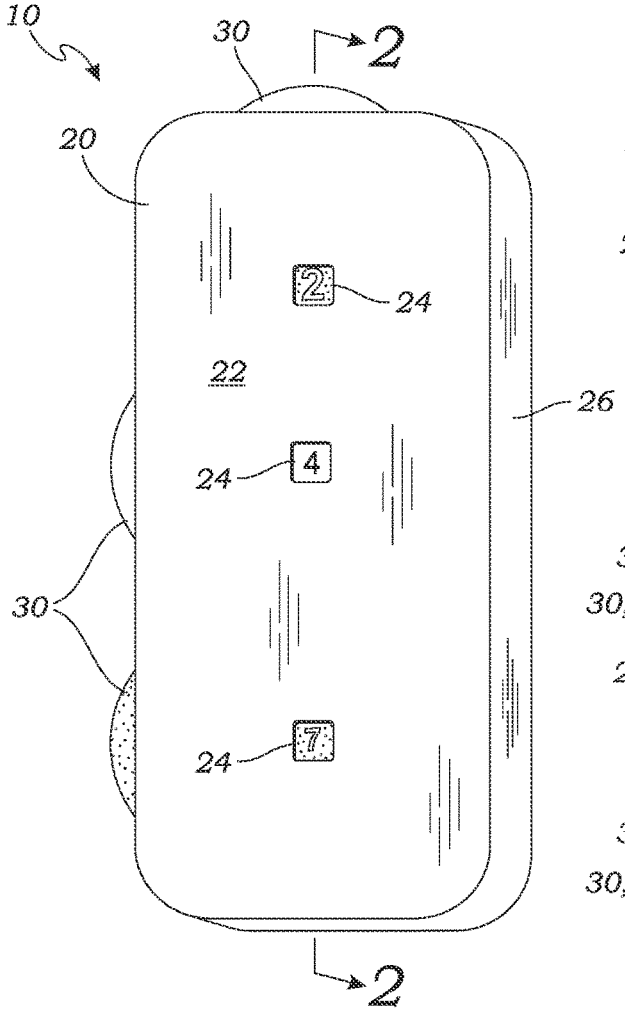
FIG. 1 is a perspective view of a mechanical pickleball scorekeeper according to one embodiment of the present invention.
Figure 2:
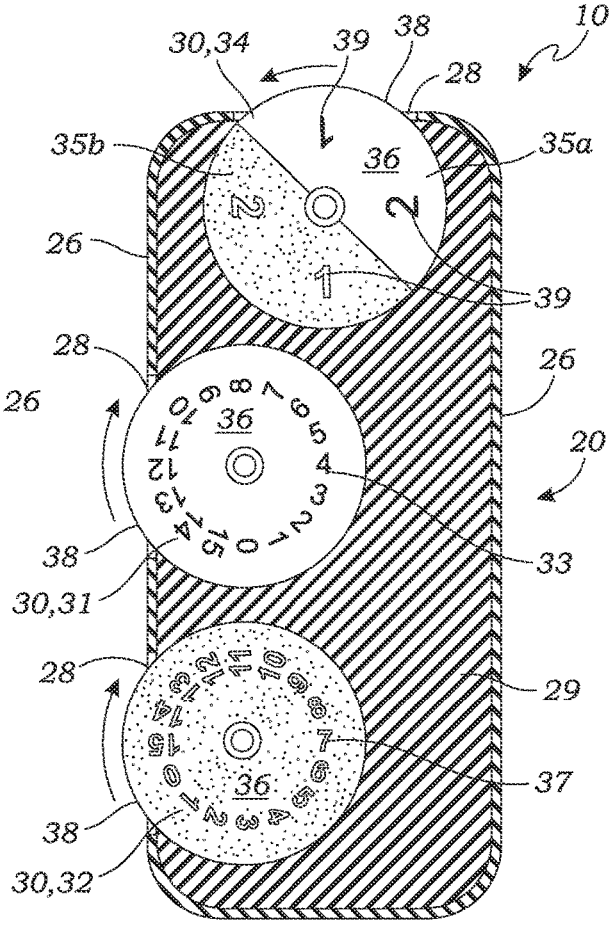
FIG. 2 is a sectional view thereof taken along line 2-2 in FIG. 1, illustrating three dials that are used for tracking a pickleball game.

FIG. 1 is a perspective view of a mechanical pickleball scorekeeper 10 according to one embodiment of the present invention, and FIG. 2 is a sectional view thereof taken along line 2-2 in FIG. 1, illustrating three dials 30 that are used for tracking a pickleball game. As shown in FIGS. 1-2, the mechanical pickleball scorekeeper 10 comprises a housing 20 sized and shaped to be hand-held by the user, and the three dials 30 mounted within the housing 20 to track server and score of a pickleball game.

The housing 20 comprises a top surface 22 that extends outwardly to an outer edge 26. Three windows 24 are formed through the top surface 22 for enabling the display of numbers on the dials, as described in greater detail below. For purposes of this application, the term "windows" is defied to include a hole through the top surface 22 as illustrated, or in any other equivalent structure that displays one of the numbers, e.g., a recess or notch in the outer edge 26, or any other equivalent structure known in the art that functions to allow viewing of a selected one of a number or indicia.

The dials 30 may extend outwardly beyond the outer edge 26 to enable turning the dials 30. The outer edge 26 may include three openings 28 through which the dials 30 extend. However, in some embodiments, the outer edge 26 may simply all be open; and furthermore, the outer edge 26 may have recesses which allow the dials 30 to be accessed, and this configuration should be considered within the scope of the present invention.

The top surface 22 may be mounted on a bottom portion 29, so that the dials 30 are mounted on the bottom portion 29 (or alternatively on the top portion) and sandwiched therebetween. While on embodiment of the housing 20 is disclosed herein, other shapes and configurations may be implemented. For example, a finger grip contour (not shown) may be formed in/on the outer edge 26, to enable the user to hold it more securely, and a wrist strap (not shown) may be attached to the housing 20. Further accessories, such as a whistle or light, may also be integrated to facilitate use of the device 10. In some embodiments, the housing 20 is generally rectangular, but any suitable shape may be used, and should be considered within the scope of the present invention.

Figure 3:
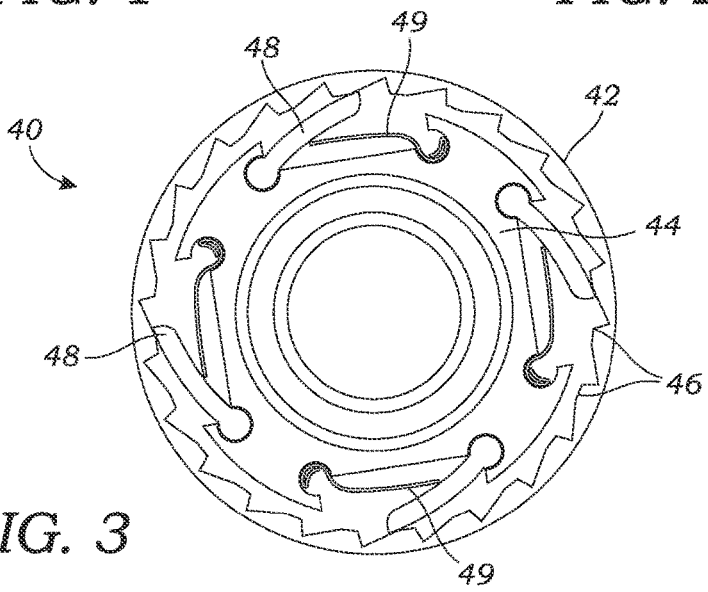
FIG. 3 is a top plan sectional view of one of the dials of FIG. 2, illustrating a ratchet mechanism used with each of the dials in one embodiment of the mechanical pickleball scorekeeper.

A ratchet mechanism 40, shown in FIG. 3, is provided in or on or otherwise associated with the housing 20, with one of the three dials 30 mounted on or adjacent the ratchet mechanism 40. In this embodiment, each of the dials 30 is mounted on top of the ratchet mechanism 40, in this case three separate mechanisms (although it could be provided by a single mechanism). One embodiment of the ratchet mechanisms 40 is shown in FIG. 3 and discussed in greater detail below. However, alternative forms of ratchet mechanisms may also be used, and the term "ratchet mechanism" is defined to be broadly construed to include any form of mechanism that enables movement of the dials 30 through a series of discrete positions. For example, a plurality of recesses, with at least one protrusion which snaps from recess to recess, thereby providing discrete positions which the user can rotate through during use. Willingham, U.S. Pat. No. 3,455,273, teaches another form of ratchet mechanism, and this disclosure is incorporated by reference in full.

As shown in FIGS. 1-2, each dial 30 has a top surface 36 that extends outwardly to an outer perimeter edge 38, wherein a portion of the top surface 36 is visible through one of the three windows 24 of the housing 20, and a portion of the outer perimeter edge 38 of the dial 30 extends beyond the outer edge 26 of the housing, through one of the three openings 28 of the outer edge 26 of the housing 20.

As shown in FIG. 2, one of the three dials 30 is a first team score dial 31 that includes numbers 33 (at least 0-11, in this embodiment, numbers 0-11, they could also include additional numbers as well, and or any other symbols desired) circumferentially spaced around the top surface 36. While 0-11 numbers are shown and described herein, it is possible for more numbers to be included (i.e., 21 for one version of pickleball scoring), or indicia other than numbers, i.e., a graphic or word, etc. Furthermore, additional dials may be included to track other game events or metrics, as determined by one skilled in the art.

The first team score dial 31 may include a first color, which is provided in some manner on the first team score dial 31, and a second color which is provided on the second team score dial 32. In this case the numbers 33 are printed in the first color; however, it may alternatively be the color of the top surface 36. The numbers 33 are preferably adjacent the outer perimeter edge 38 of the dial 30 and circumferentially spaced so that one of the numbers 33 is visible through one of the windows 24, as shown in FIG. 1.

For purposes of this application, the term "color" is broadly defined to include any visually distinguishable markings that enable the user to distinguish between the two dials 31 and 33, or the halves of the server dial, including but not limited to any colors (including black and white), patterns, hatchings, text, and/or other markings that may be devised by one skilled in the art.

Another one of the three dials 30 is a second team score dial 32 that similarly includes numbers 37 (as above, in this embodiment 0-11) that are circumferentially spaced around the top surface 36. The second team score dial 32 includes a second color that is different than the first color. The critical requirement is that the first and second colors are different. For example, the numbers 33 may be one color (e.g., green), while the numbers 37 may be red, or white on a contrasting background. In another example, the top surface 36 of the first team score dial 31 may be white, while the top surface 36 of the first team score dial 32 may be shaded a different color, such as gray, light red, etc. In this case, the numbers and the surfaces have distinctive colors so it is easy to distinguish the first team from the second team.

One of the three dials 30 is a server number dial 34 that is divided into two halves 35*a* and 35*b*, each half having a server indicia 39. In this case, a first server indicia is used to indicate a first server, and a second server indicia is used to indicate a second server. In this embodiment, this is provided in the form of numbers (e.g., 1 and 2), indicating the current server for the game; however, other forms of indicia may be used, including but not limited to A and B, or any other name, symbol, or marking that may be used to indicate a particular server. One of the two halves 35*a* has a distinguishing color that is different from the color of the other of the two halves 35*b*.

In one embodiment, the first color of the first team score dial 31 may be the same as one half 35*a* of the server number dial 34, and the second color of the second team score dial 32 may be the same as the other half 35*b*, such that the server number and team score numbers each correspond to one of two teams playing pickleball. The colors may be applied to the entire top surface 36 of each dial 30 (shading, stippling, etc.), or in some embodiments, only the numbers are colored, or both may be colored (the same color, or different colors). Any colors may be used, and any suitable combination of colors, patterns, or graphic designs may be implemented, as long as the colors are reasonably distinguishable.

FIG. 3 is a top plan sectional view of one of the dials 30 of FIG. 2, illustrating the ratchet mechanism 40 used with each of the dials 30 in one embodiment of the mechanical pickleball scorekeeper 10. As shown in FIG. 3, in this embodiment, a downwardly extending annular ring 42 extends downwardly from each of the dials 30, and the ratchet mechanism 40 is in the form of a fixed ratchet ring 44 that includes one or more pawls 48 that are biased to extend outwardly via springs 49. The pawls 48 engage teeth 46 of the ring 42 such that the dial 30 may be rotated in one direction by the user via the exposed outer perimeter edge 38 (in FIG. 2). In this embodiment, the dial 30 cannot be rotated in an opposite direction due to the ratchet mechanism 40. This may include embodiments where the ratchet teeth and pawls are reversed, or wherein there is a single fixed pawl that contacts a simple ratchet gear, or any other suitable mechanism known in the art. Alternative ratchet mechanisms, such as the embodiment shown in FIG. 4, may enable movement in either direction.

Figure 4:
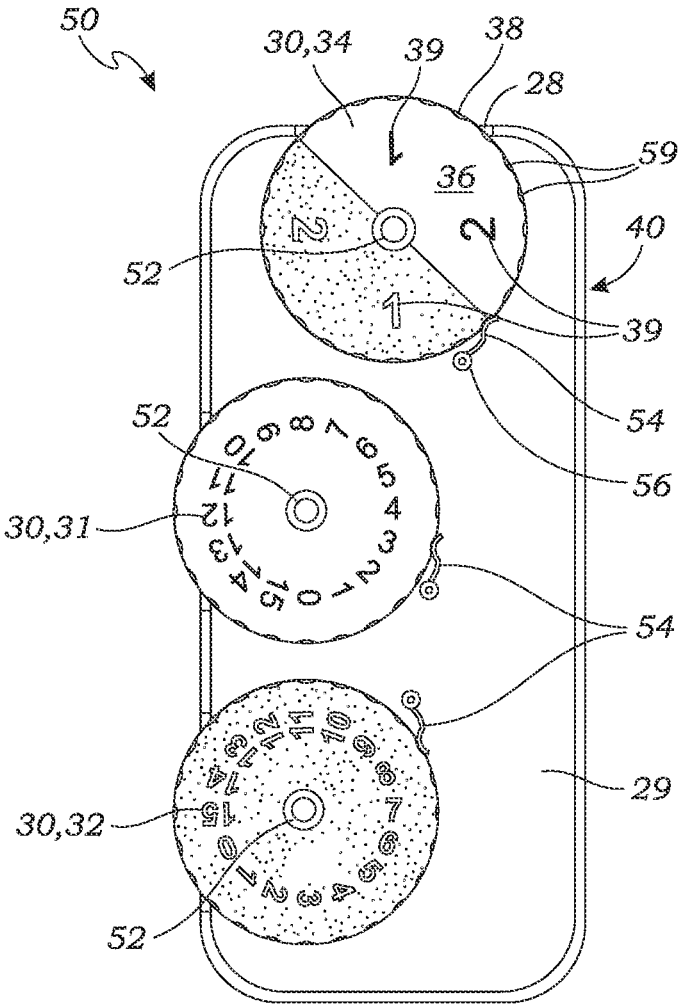
FIG. 4 is a sectional view similar to FIG. 2, illustrating another embodiment of the ratchet mechanism.

FIG. 4 is a sectional view similar to FIG. 2, illustrating another embodiment of the ratchet mechanism 40, wherein the dials 30 are mounted via a hub 52 to the bottom portion 29 of the housing 20 (shown in FIG. 1). In this embodiment, the ratchet mechanism 40 includes a spring 54 that is mounted to the bottom portion 29 of the housing 20 (shown in FIG. 1) via a mounting point 56. A curved end opposite the mounting point engages recesses 59 in the outer perimeter edge 38 of the dial 30. In this embodiment, the dial 30 may be turned in either direction, but the ratchet mechanism 40 biases the dial 30 towards predetermined circumferentially spaced positions that correspond with each of the numbers.

In use, as shown in FIGS. 1-4, the pickleball scorekeeper 10 enables a user to track a score for each team in a pickleball match, and for tracking a server number during the match. Proper sequence for calling a pickleball score in doubles is: server score, receiver score, then the server indicia (e.g., 1 or 2). In some uses, a game may be played up to, for example, 11, but in other uses, as in a tournament, the game may be played up to 11. The user holds the scorekeeper 10 and adjusts the server number dial 34 to 1 to indicate the first server of the team that corresponds to the color visible through the window 24 of the scorekeeper housing 20. Both scores are initially set to zero.

When the first server scores, the user adjusts the first team score dial 31 to add a point to the number of points scored. When the server faults out, the server changes to the second server, the user adjusts the server number dial 34 to 2 on the same half 35*a* of the server number dial 34, so the color corresponding to the first team is still visible. If the second server of the first team scores, the user adjusts the first team score dial 31 to reflect points scored. When the second server from the first team faults out, the user adjusts the server number dial 34 to 1 of the other half 35*b* of the server number dial 34, so that the color corresponding to the second team is visible. If the first server of the second team scores, the user adjusts the second team score dial 32 to reflect points scored, and so on.

If a user wishes to track a game that concludes at, for example, 11 points, the user may simply stop at 11 on the first or second team score dial 31 or 32. If a user wishes to track a singles' game, the user may simply rotate the server number dial 34 to show only the 1 of each half 35*a* and 35*b*, or the user may use only the first and second team score dials 31 and 32.

Figure 5:
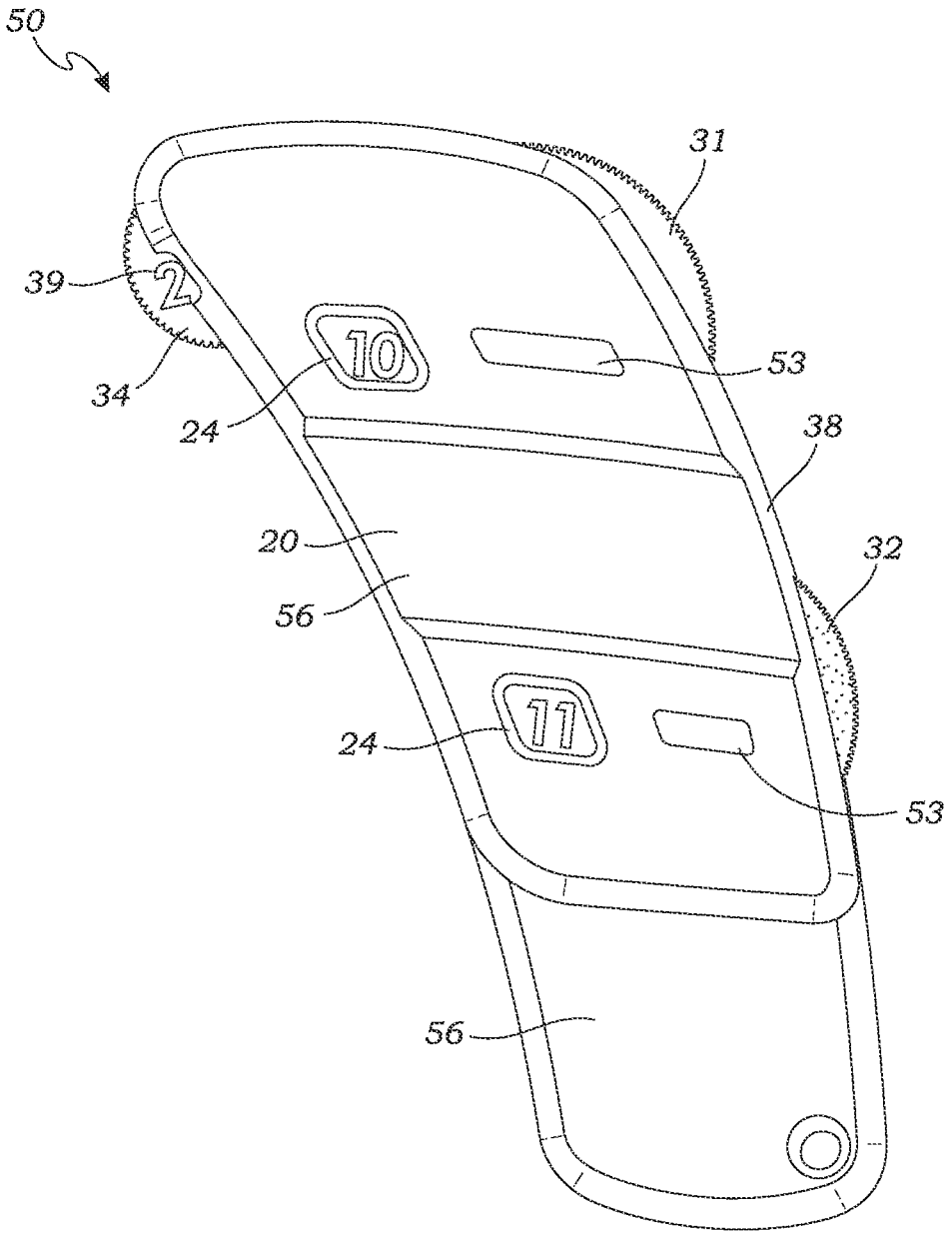
FIG. 5 is a top plan view of a second embodiment of the mechanical pickleball scorekeeper.

FIG. 5 is a top plan view of a second embodiment 50 of the mechanical pickleball scorekeeper. As shown in FIG. 5, in various embodiments, the housing 20 may be formed in a wide range of shapes for hand-held use. In this embodiment, the perimeter edge 38 of the housing 20 has a curve, and the numbers 39 of the server number dial 34 are visible on the outside of the housing 20, rather than being visible through a window 24 as in the previous embodiment. Furthermore, color indicators 53 may be included beside the windows 24 of the team score dials 31 and 32, wherein the color indicators 53 correlate with the color of the adjacent team score dial 31 or 32. The housing 20 of the embodiment 50 of FIG. 5 may further include recessed portions 56 to enhance tactile sensation/grip.

Figure 6:
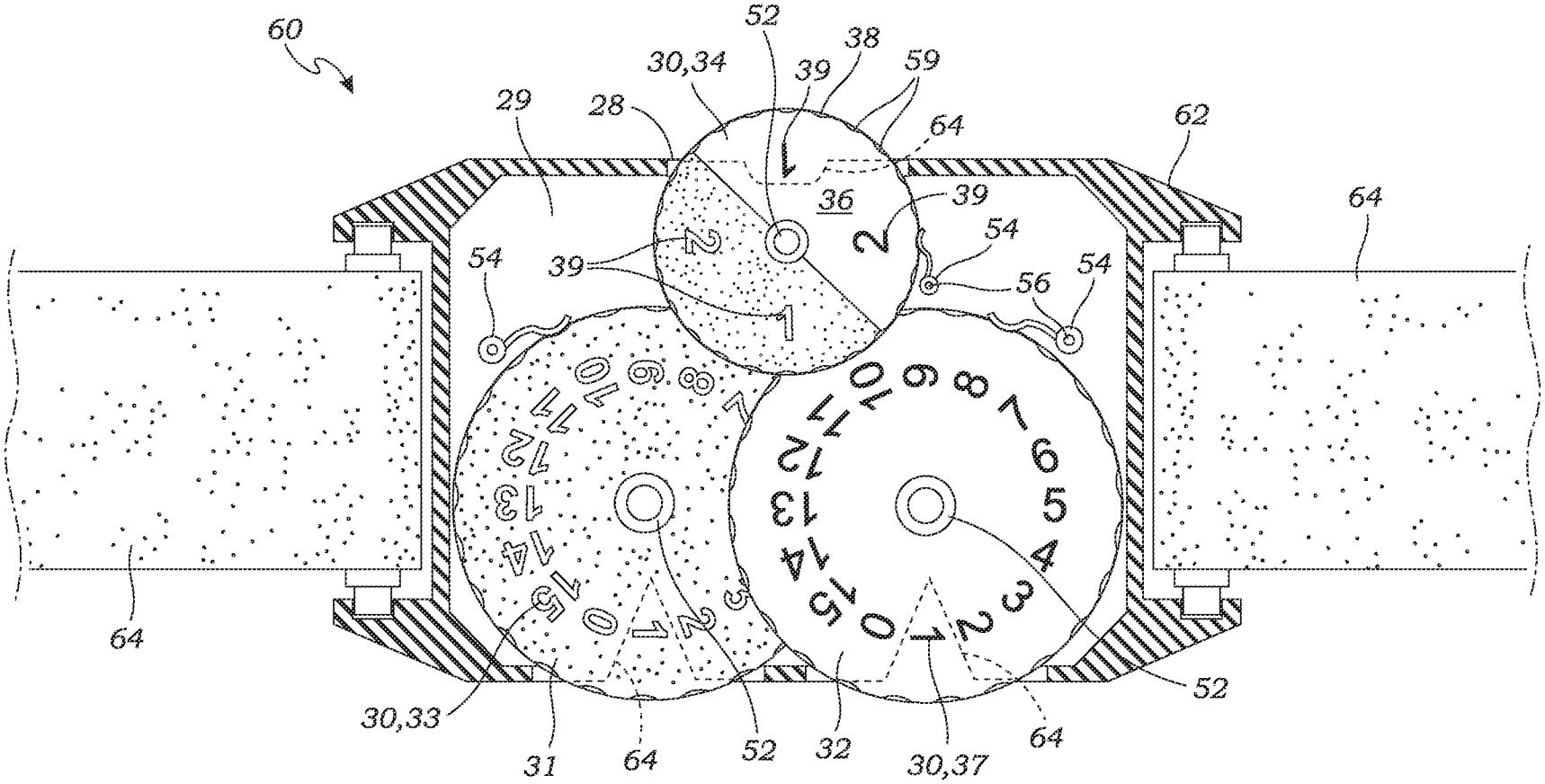
FIG. 6 is a third embodiment thereof.

FIG. 6 is a third embodiment 60 of the mechanical pickleball scorekeeper. As shown in FIG. 6, in this embodiment, the mechanical pickleball scorekeeper comprises a housing 62 that is sized and adapted to be worn on the user's wrist via a wristband 64. The three dials 30 are positioned within the housing 62 in an overlapping configuration, to save space within the housing 62 without overly compromising the sizes of the dials 30. As illustrated, cutouts 64 may be formed in the top surface of the housing 62, to expose the numbers 33, 37, and 39 on the dials 30. The embodiments of FIGS. 5 and 6 may include any additional features discussed in the first embodiment 10, including any suitable form of ratchet mechanism, ornamental features, or any other features compatible with the invention as claimed.

The title of the present application, and the claims presented, do not limit what may be claimed in the future, based upon and supported by the present application. Furthermore, any features shown in any of the drawings may be combined with any features from any other drawings to form an invention which may be claimed.

As used in this application, the words "a," "an," and "one" are defined to include one or more of the referenced item unless specifically stated otherwise. The terms "approximately" and "about" are defined to mean +/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A mechanical pickleball scorekeeper for enabling a user to track a score for each team in a pickleball match, and for tracking a serve number during the match, the mechanical pickleball scorekeeper comprising:

a housing having a top surface that extends outwardly to an outer edge;

three dials, each of the three dials having a top surface that extends outwardly to an outer perimeter edge, each of the three dials being operably mounted on the housing;

wherein one of the three dials is a first team score dial that includes numbers circumferentially spaced around the top surface;

wherein one of the three dials is a second team score dial that includes numbers circumferentially spaced around the top surface; and wherein one of the three dials is a server number dial that is divided into two halves, each half having a server indicia, wherein one of the two halves has a distinguishing color that is different from the other of the two halves.

2. The mechanical pickleball scorekeeper of claim 1, wherein the number on the first and second team score dials are from 0-11.

3. The mechanical pickleball scorekeeper of claim 1, wherein the housing is sized and shaped to be hand-held by the user.

4. The mechanical pickleball scorekeeper of claim 1, wherein the server indicia include a 1 and a 2.

5. The mechanical pickleball scorekeeper of claim 1, wherein the housing is adapted to be worn on the wrist of the user.

6. The mechanical pickleball scorekeeper of claim 5, wherein the three dials are positioned such that they overlap within the housing.

7. A mechanical pickleball scorekeeper for enabling a user to track a score for each team in a pickleball match, and for tracking a serve number during the match, the mechanical pickleball scorekeeper comprising:

a housing sized and shaped to be hand-held by the user, the housing having a top surface that extends outwardly to an outer edge;

three windows through the top surface of the housing;

three ratchet mechanisms mounted in the housing;

three dials, each of the three dials having a top surface that extends outwardly to an outer perimeter edge, each of the three dials being operably mounted with one of the ratchet mechanisms so that a portion of the top surface of the dial is visible through one of the three windows, and a portion of the outer perimeter edge of the dial extends past the outer edge of the housing, such that each of the three dials may be rotated;

wherein one of the three dials is a first team score dial that includes numbers circumferentially spaced around the top surface, and a first color;

wherein one of the three dials is a second team score dial that includes numbers circumferentially spaced around the top surface, and a second color that is different than the first color; and wherein one of the three dials is a server number dial that is divided into two halves, one half having the first color, and the other half having the second color, wherein the first color of the first team score dial corresponds to one half of the server number dial and the second color of the second team score dial corresponds to the other half of the server number dial, such that the visible half of the server number dial visually identifies which team is currently serving.

8. The mechanical pickleball scorekeeper of claim 7, wherein the first color is green and the second color is white.

9. The mechanical pickleball scorekeeper of claim 7, wherein the numbers on the top surface of the first team score dial are printed with the first color, and the numbers on the top surface of the second team score dial are printed with the second color.

* * * * *